US005609039A

United States Patent [19]

Green et al.

[11] Patent Number: 5,609,039

[45] Date of Patent: Mar. 11, 1997

[54] COOLING CARTRIDGE FOR PLASTIC DRINKING BOTTLES

[75] Inventors: Dennis E. Green, 102 Falcon Hills Dr., Highlands Ranch, Colo. 80126; Harry Collier, Highlands Ranch, Colo.

[73] Assignee: Dennis E. Green, Highlands Ranch, Colo.

[21] Appl. No.: 449,018

[22] Filed: May 24, 1995

[51] Int. Cl.[6] ..... F25D 3/08

[52] U.S. Cl. ..... 62/475.3; 62/457.4; 62/529; 62/371

[58] Field of Search ..... 62/457.3, 457.4, 62/529, 371, 372, 530; 165/80.1, 185

[56] References Cited

U.S. PATENT DOCUMENTS

| | | | |
|---|---|---|---|
| 298,694 | 5/1884 | Jewett | 62/457.4 |
| 2,605,620 | 8/1952 | Taylor | 165/185 |
| 2,997,858 | 8/1961 | Perez | 62/529 |
| 3,059,452 | 10/1962 | Griffin | 62/529 |
| 3,128,756 | 4/1964 | Galvin | 165/185 |
| 3,840,153 | 10/1974 | Devlin | 222/146 |
| 4,183,226 | 1/1980 | Moore | 62/457 |
| 4,338,795 | 7/1982 | House, Jr. | 62/372 |
| 4,383,422 | 5/1983 | Gordon et al. | 62/457 |
| 4,741,176 | 5/1988 | Johnson et al. | 62/457 |
| 4,989,418 | 2/1991 | Hewlett | 62/457.4 |
| 5,009,083 | 4/1991 | Spinos et al. | 62/400 |
| 5,058,396 | 10/1991 | Faiola | 62/457.2 |
| 5,090,213 | 2/1992 | Glassman | 62/457.3 |
| 5,129,238 | 7/1992 | Schwartz et al. | 62/457.3 |
| 5,148,688 | 9/1992 | Pimm et al. | 62/457.3 |
| 5,177,981 | 1/1993 | Haas | 62/457.3 |
| 5,235,823 | 8/1993 | Coker | 62/530 |
| 5,269,368 | 12/1993 | Schneider et al. | 165/46 |
| 5,271,244 | 12/1993 | Staggs | 62/457.3 |
| 5,313,807 | 5/1994 | Owen | 62/457.3 |
| 5,456,090 | 10/1995 | McCoy | 62/457.3 |

FOREIGN PATENT DOCUMENTS

| | | | |
|---|---|---|---|
| 844800 | 4/1938 | France | 62/530 |

*Primary Examiner*—William E. Tapolcai
*Attorney, Agent, or Firm*—Dorr, Carson, Sloan & Birney, PC

[57] ABSTRACT

A combination drinking bottle and internal cooling cartridge comprises a cooling cartridge having a top surface and a bottom surface, with a tubulate side wall extending between the top surface and the bottom surface and having a plurality of longitudinal protrusions, each adjacent pair of longitudinal protrusions being separated by a longitudinally extending concave surface. A refrigerant is sealed within an interior cavity formed by the side wall and top and bottom surfaces of the cartridge. The drinking bottle has an interior cavity for containing a quantity of a beverage and the cooling cartridge, which are inserted through a tubulate mouth into the interior cavity of the bottle. The interior cavity also provides lateral support from its side walls to maintain the cooling cartridge in a substantially vertical orientation within the bottle.

9 Claims, 11 Drawing Sheets

Fig. 5(b)
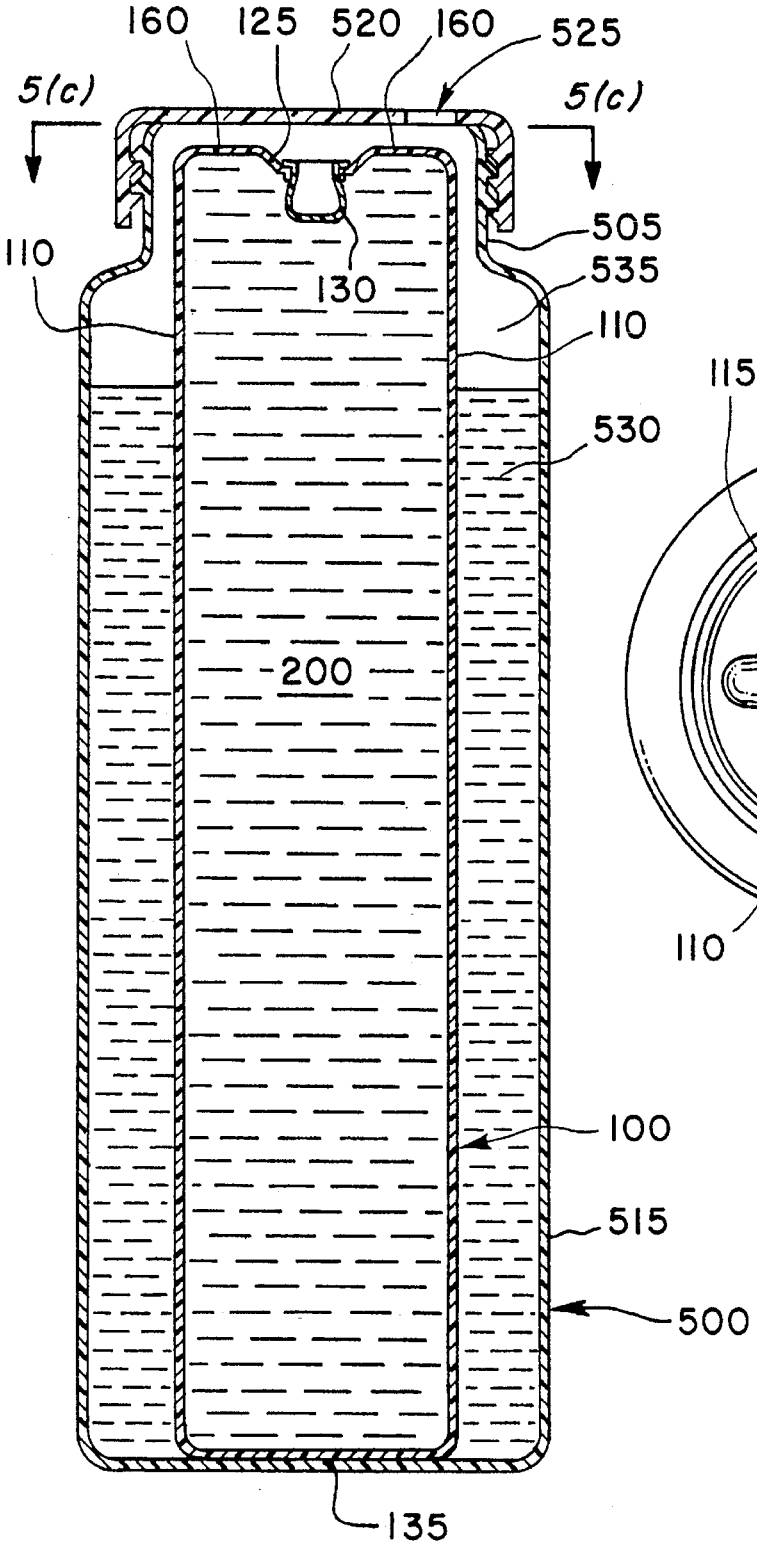
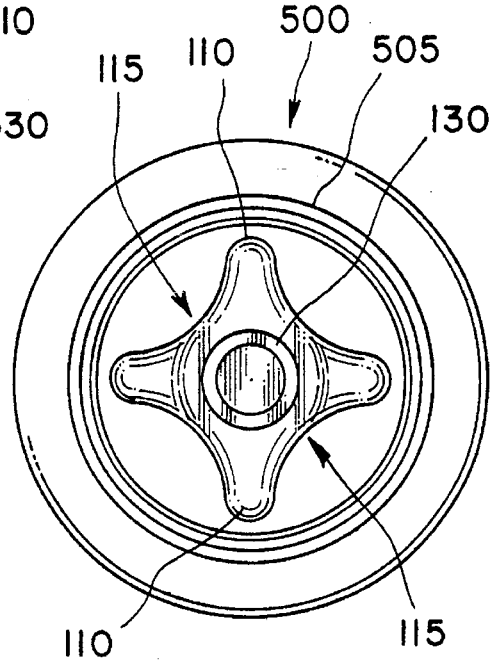
Fig. 5(c)

COOLING CARTRIDGE FOR PLASTIC DRINKING BOTTLES

BACKGROUND OF THE INVENTION

1. Field of the Invention

The present invention relates to hand-held drink containers. More particularly, the present invention relates to an immersible cooling cartridge inserted into a drink container for rapid cooling of the contents and maintenance of cool temperatures for a length of time.

2. Statement of the Problem

Refillable plastic drink containers with sealing caps have been conventionally used for many years for conveniently transporting beverages while providing for their consumption. There is an enormous and growing consumer usage of plastic drinking containers known generally as sports bottles. Sports bottles are convenient, reusable, inexpensive, flexible plastic drinking containers with screw-on or snap-on sealing caps and provisions for drinking therefrom. They are manufactured in several sizes; however, the vast majority exist in just a few standard sizes, both volumetrically and dimensionally.

It is estimated that several billion sports bottles are in use today worldwide. While normally not insulated, these bottles are still the favorite container for many people for carrying chilled beverages. The bottles are typically provided with either a flexible plastic drinking straw that extends from the outside through a hole in a plastic cap and from there to the bottom of the container, or with a reversibly sealable drinking spout located centrally on the plastic cap and manufactured as a part of the cap. Typically, caps attach reversibly by either threaded attachments or snap-on attachments.

Sports bottles are typically manufactured from a low-density or high-density polyethylene (LDPE or HDPE) or other flexible plastic that can be formed via a very low cost blow molding process. Typically having single-thickness side walls, sports bottles have relatively poor insulative qualities, but are sometimes fitted with insulating sleeves, wraps, or holders, the use of which provides a partial thermal insulation for the contents.

There are two prominent categories of sports bottles. The first type is a bottle designed for use during active participation in a sports activity, such as bicycling or climbing. This type of sports bottle is made typically from a thick-walled LDPE (0.040 to 0.050 inch), has a rubberlike, heavy-duty feel, and does not collapse in the hand. These bottles have relatively narrow, strong necks and are often provided with a second narrow section in the mid-portion of their cylindrical body for grasping while participating in a sports activity. These bottles are designed to be used under stressful conditions and are designed with just enough flexibility to allow for fluid to be squirted out while otherwise maintaining their structural integrity for consistent grasping and retaining within a holder. Sports bottles of this first category are typically provided with snap-on caps containing an integral, centrally located, recloseable drinking spout. The drinking spout is designed to be opened and re-closed with the mouth so as to allow drinking while minimally interfering with an on-going activity. While many sizes have been manufactured, two sizes dominate the market. Volumetrically, the two sizes are approximately 16 oz. and 26 oz. and were originally selected with significant consideration being given to the weight of water being transported during performance of a sports activity. Dimensionally, the two sizes differ only in the length or height of the cylindrical body rather than in the diameter, thus maintaining a standard for easy gripping and for bottle holders. The conventional diameter for these sports activity bottles is 2.9 inches, and the two standard heights are 7.125 inches and 9.25 inches from base to rim. The necks, mentioned above, have an inner diameter of approximately 1.4 inches. Sports bottles for use during physical activity have been in general use for over twenty years and were originally designed for carrying beverages while bicycling, although they now find many other uses, such as during hiking, jogging, and other physical activities. We call this first type of sports bottle an "activity sports bottle" herein.

The second major category of sports bottle is generally designed for convenience of transporting and consuming larger amounts of beverage while at rest or on break from an activity and not for use during active sports participation. In the design of this type of drinking bottle, more consideration is given to transporting large beverage volumes and to convenience of consumption rather than to any activities in which a consumer may be involved. We call this second type of sports bottle a "convenience bottle" herein. The term "drinking bottle" comprises both activity sports bottles and convenience bottles.

Convenience bottles are normally larger than traditional activity sports bottles. The smaller sizes of the convenience bottles typically have a larger volume than the larger sizes of the activity sports bottles. Convenience bottles have been in wide use for about ten years. Convenience bottles are normally manufactured from very thin 0.020-inch to 0.030-inch HDPE. This thin wall material combined with a significantly larger surface area causes convenience bottles to be more easily (but reversibly) deformed than activity sports bottles, and convenience bottles in fact may undergo significant deformation during normal carrying or drinking. Convenience bottles are typically cylindrical and range in volume from about 24 oz. to about 40 oz. Inside neck dimensions of 63 mm, 70 mm, or 80 mm; body diameters of 3 to 3¼ inches; and body heights of 8½ to 9¼ inches define the conventional dimensional ranges of convenience bottles. Although there are many variations in the marketplace, the vast majority of convenience bottles fit within the conventional dimensional ranges. One significant shape variation is the cup holder shape. In this type of convenience bottle, the cylindrical body transitions to a narrower radius along its lower portion. The lower 2½ to 3 inches of the convenience bottle are formed with a diameter of about 2½ inches to enable the bottle to fit into cup holders, such as those found in automobiles.

Most beverages carried in drinking bottles are normally considered most enjoyable if consumed while cold. Many means exist to cool beverages in a variety of transportable containers such as drinking bottles. The traditional means to chill drinks in a reusable bottle is, of course, by the use of ice. Ice, like other beverage-cooling agents, cools the drink in which it is contained by absorbing heat originating from the ambient environment and from the drink itself. The hotter the day, the faster the ice absorbs the heat. When ice absorbs heat it melts into the drink, diluting and usually degrading the quality of the beverage. The hotter the day, therefore, the faster the drink becomes diluted, flat, and tasteless. Furthermore, ice floats to the top of the beverage, reducing its potential effectiveness as a coolant. Also, ice is often dirty, either from dust accumulation on its surface while standing in a freezing compartment, or from contaminants in the water from which it was formed. Any such contaminants are released into the beverage as the ice melts.

Additionally, without an ice maker, ice is inconvenient to make and handle. Furthermore, ice is inconvenient to transport in small quantities to locations remote from a freezer for recharging a drink container during the day.

Many devices have been developed to replace ice as a refrigerant for beverages contained in reusable drinking containers. Two general approaches are seen. One common approach has been the use of an exterior enclosure that fits around the container and that contains a freezable refrigerant, such as the enclosures disclosed in the following United States Patents:

| Inventor | U.S. Pat. No. | Issue date |
|---|---|---|
| Moore | 4,183,226 | Jan. 15, 1980 |
| House, Jr. | 4,338,795 | July 13, 1982 |
| Gordon et al. | 4,383,422 | May 17, 1983 |
| Johnson et al. | 4,741,176 | May 3, 1988 |
| Hewlett | 4,989,418 | Feb. 5, 1991 |
| Schneider et al. | 5,269,368 | Dec. 14, 1993 |
| Owen | 5,313,807 | May 24, 1994 |

Although each of these descriptions sets forth devices for cooling liquids in a beverage container, they have significant drawbacks in their use. Exterior-mounted cooling devices are bulky, making the drink container more difficult to hold or to fit into a drink holder. Furthermore, to provide effective cooling, an exterior mount device must accommodate the shape and size of the beverage container. Exterior mount devices of fixed diameter will not accommodate the various-sized drinking bottle diameters. Some devices with adjustable diameters, such as those discussed by Schneider et al., accommodate the drinking bottle shape by using a refrigerant that is not frozen and therefore provides only marginal cooling capacity. To avoid the problem of conforming to the container shape, some designs, such as that discussed by Owen, provide for several removable coolant "capsules" that are frozen and then installed within an insulated exterior container wrap, thus fitting incrementally around the arcuate shape of the container. In addition to the burden of preparing and inserting several cartridges to cool a single beverage, the total amount of coolant and cooling area provided by this approach may not be sufficient to adequately chill a beverage. Another problem common to most exterior mount beverage container cooling devices is the difficulty in preparation and portability. The large size of an exterior device consumes an inordinate amount of freezer space during preparation. The bulk of an exterior device makes it generally inconvenient to transport additional devices in an insulated container for recharging the beverage container while away from a freezer for an extended time. Also, exterior devices require use of a large amount of insulation, such as the device shown by Johnson et al., since a large portion of the cooling cartridge surface area is not in contact with the beverage in the container. Thermal transfer across the outside surface wastes cooling capacity that could be utilized to chill the beverage.

A second common approach to cooling beverages enclosed in reusable drink containers involves placing a cooling device (or devices) inside a drink container, immersed in the beverage contained therein, to chill the beverage.

The primary technical considerations regarding chilling of a beverage in a non-insulated drinking container by use of an immersible cooling cartridge include the limited heat transfer rate between the external environment and the beverage and between the beverage and the cooling cartridge. If a gel refrigerant is to be used, the heat transfer through the refrigerant itself is also a consideration since there is minimal convection within a gel medium. Another technical consideration is the amount of heat that must initially be removed from the beverage to chill it to the desired drinking temperature. Still other considerations are the "cooling capacity" or, more properly, the latent heat of fusion and the heat capacity of the refrigerant and the melting temperature of a freezable refrigerant. Of course, the use of nontoxic refrigerants is a necessary design criterion for any cooling cartridge that is expected to be in contact with food items.

Important cooling cartridge structural design issues further include the maintenance of orientation of the cooling cartridge within the drinking bottle for most effective chilling, the resilience of the cartridge walls to repeated expansive forces resulting from repeated refreezing of the refrigerant within the cartridge, and the permanent sealing of the refrigerant inside the cartridge.

The heat transfer rate across cartridge and drinking bottle side walls is proportional to the temperature differential across those walls and to the surface areas of the walls. The very thin plastic material of the side walls of the drinking bottle provides only relatively poor insulative quality; however, any unnecessary increase in the side wall thickness of the cooling cartridge can significantly affect its cooling efficiency. Since the purpose herein is to provide a cooling system for non-insulated, or only partially insulated, drinking bottles of standard dimensions, the major areas of design control over heat transfer are concerned with the surface area of the cooling cartridge, the wall thickness thereof, and the refrigerant materials contained within the cartridge. Typically, a conventional convenience bottle has a surface area of approximately 100 square inches. This is a considerable surface area, especially when considering that a conventional cylindrical cooling cartridge, such as that generally described below by Schwartz et al. in U.S. Pat. No. 5,129,238, issued Jul. 14, 1992, or that of Devlin, U.S. Pat. No. 3,840,153, issued Oct. 8, 1974, can be expected to have a surface area of less than 50 square inches. The ambient temperature creates a heat load upon the beverage contained within the drinking bottle that must be countered by the absorption of heat into the cooling cartridge in order to maintain an acceptable beverage drinking temperature.

The ratio of surface area to volume is one performance indicator for an immersible cooling cartridge. As surface area increases, the heat transfer rate increases, and as the volume of refrigerant increases, the total cooling capacity increases. Refrigerant volume is, however, increased at the expense of consumable beverage. Acceptable beverage sacrifice is typically considered to be up to 30 percent of the available volume, or about 7 oz. to 9 oz. in the range of conventional convenience bottles. A surface area/volume ratio between 3 and 3.5 gives excellent performance in non-insulated convenience bottles. A ratio below 3 can conserve the refrigerant; however, this reduction comes at the expense of adequate beverage chilling when ambient temperatures exceed 75 degrees Fahrenheit. A ratio over 3.5 chills the beverage maximally, but expends the refrigerant too quickly.

As mentioned above, the initial temperature of the beverage has an important impact on the overall cooling effectiveness of a cooling cartridge placed within the beverage. The warmer the initial beverage temperature, the more heat will be absorbed by the cooling cartridge in the process of bringing the beverage temperature down to an acceptable drinking temperature and the less cooling capacity will remain to maintain that temperature against the heat load created by the ambient environment. Most beverages kept in drinking bottles have heat capacities very close to that of water. If the beverage to be chilled is water and it is obtained from the tap, the initial temperature can be expected to be about 58 degrees to 64 degrees Fahrenheit, whereas a soda from a fountain machine can be expected to have an initial temperature several degrees cooler. A soda off the shelf may be at room temperature, or about 72 degrees Fahrenheit, and a soda from a refrigerator may have an initial temperature of about 36 degrees to 40 degrees Fahrenheit. It is impossible to predict the initial temperature of a beverage placed within a drinking bottle, but it is possible to design for a variety of expected cases and to provide, through creative cooling cartridge design, the best relative performance available.

The total cooling capacity of a cooling cartridge depends on the latent heat of fusion (for freezable refrigerant), the heat capacity of the refrigerant, and the volume of refrigerant contained within the cartridge. Gel refrigerants are available that have latent heats of fusion comparable to that of water and heat capacities often higher than that of water. Furthermore, since the heat transfer rate is dependent on the temperature differential, it is wise to select a refrigerant having a freezing point no lower than necessary to maintain an acceptably chilled drink under the expected range of environmental conditions. Additionally, the total cooling capacity of a refrigerant generally decreases as the mixture concentrations are adjusted to lower the freezing point of the refrigerant.

One application of the immersible cooling cartridge approach, sometimes known as artificial ice cubes (many devices exist in the market going by various trade names), has been seen in the market in various embodiments for many years. Artificial ice typically consists of small plastic-enclosed coolant (usually water) containers approximating the size of ice cubes and often manufactured in other shapes, such as animals. These small, odd-shaped plastic cartridges are difficult to store, handle, and use. Typically a separate container must be kept in the freezer compartment to keep the small cartridges from scattering throughout the compartment while they are being prepared for use. Furthermore, they tend to use more space than the equivalent amount of ice cubes or larger cooling cartridges because their shapes do not allow for efficient packing. Their shapes are typically round and do not provide even the surface area/volume ratio of an ice cube or cylindrical container. In use, several (often up to six or more) must be removed from the freezer and placed into a drink, a tedious juggling act considering their natural tendency to slip away and fall to the floor. In use, like ice, artificial ice capsules float to the top of the drink and make direct contact with the walls of the container, thereby allowing portions of the drink farther removed from the cartridges to become undesirably warm and also inefficiently absorbing heat directly from the environment. Also, there is no convenient means to transport extra cartridges. The low surface area to volume ratio combined with the tendency of the cartridges to float makes them inefficient as drink-cooling devices.

Schwartz et al. in U.S. Pat. No. 5,129,238, issued Jul. 14, 1992, disclose a cylindrical cooling cartridge for a convenience bottle that attaches to the underside of the bottle cap via a threaded connection, extending into the bottle and maintaining direct contact for chilling by immersion in a beverage contained within the bottle. As discussed by Schwartz et al., this approach does have some advantages over the bulkier exterior enclosure type of cooling cartridges. The cartridge system of Schwartz et al. is trim and fits within the beverage for direct cooling. Although not mentioned by Schwartz et al., extra cylindrical cartridges could be easily carried in an insulated carrying case as well. However, the device of Schwartz et al. also has several major drawbacks. First, it requires a specially manufactured cap into which the cooling cartridge attaches. Since the cartridge attachment requires an attachment to the cap and more specifically to the center of the cap, it cannot be used by the large number of people who prefer to use drinking bottles with recloseable center spouts. Furthermore, the cylindrical cooling cartridge of Schwartz et al. is attached at one end to the center of the bottle cap. Suspension of the relatively heavy cylinder when the bottle is laid onto its side can cause significant stress to a small area of the cap adjacent to the mount location and at the attachment end of the cartridge itself. The stress created at the mount location could cause cracking of the cap. The stress created on the end of the cartridge could cause splitting of the cartridge itself, allowing refrigerant to escape.

Additionally, the cylindrical shape of the cooling cartridge is a significant limitation in cooling performance. The cylindrical shape has a surface area that can be too small to allow for adequate cooling of a surrounding liquid in an non-insulated or partially insulated container on a warm day. The surface area of a cylindrical container is proportional to the radius and the length of the cylinder. A cylindrical cartridge can be manufactured with a large radius, thereby providing a surface area large enough to maintain the required cooling of a beverage in a non-insulated container. However, such a choice results in a commensurably larger volume displacing the beverage. The ratio of surface area to volume that can be expected in a cylindrical cartridge is on the order of 2.5; this limits the overall performance of a cylindrical cartridge in situations involving relatively high ambient temperatures.

Additionally, most refrigerant materials have a coefficient of expansion upon freezing similar to that of water. The convex shape of the external arcuate surface of a cylinder is very unforgiving when exposed to internal expansion forces. Forces transverse to the center axis of the cylinder that are created by an expansive refrigerant upon freezing could be expected to burst the walls of such a cartridge upon repeated refreezing. To avoid such a problem, the side walls of a cylindrical cartridge must be made from a relatively thick material or, as mentioned by Schwartz et al., from a "flexible" plastic. However, as the wall thickness increases, the rate of cooling of the surrounding liquid decreases owing to the lowered thermal conductivity of the thicker plastic material; this exacerbates the cooling rate limitations already imposed by a shape with a low area-to-volume ratio. Furthermore, plastics tend to lose flexibility when cooled, for example, as in preparation of a cooling cartridge. A cylindrical cartridge has little to recommend it for use as a cooling cartridge.

Other problems that exist with the invention disclosed by Schwartz et al. include the possibility of bacteria buildup within the mounting cavity if the cartridge is not removed and both the mounting cavity and the cartridge are not washed immediately following use. Furthermore, requiring a mount for stability of the cartridge within the bottle also makes the cartridge unsuitable for use in a conventional drinking bottle that does not have a cap with the proper cartridge mount.

Spinos et al., in U.S. Pat. No. 5,009,083, issued Apr. 23, 1991, discloses a beverage container and cooling cartridge combination device remarkably similar to the later invention of Schwartz et al. While the device of Spinos et al. would provide for better heat transfer from a beverage chilled within the container than the device of Schwartz et al., the Spinos device suffers from all the drawbacks noted above concerning the device of Schwartz et al. Additionally, the drinking straw passageway of Spinos et at. consists of a cavity that is very difficult to keep clean, thus creating an environment in which a buildup of dirt and bacteria is possible. Furthermore, the internal expansive forces created upon the freezing of the refrigerant contained within the cooling cartridge of Spinos et al. could cause protrusion of the straw passageway side wall into the passageway itself, making insertion of a straw into the passageway difficult or impossible. Finally, the cooling cartridge of Spinos et al., having a centrally located straw passageway, is expensive to manufacture.

A cooling cartridge device exists for sports activity bottles that is flat sided and generally cylindrical. This cartridge installs into a standard sports activity bottle by having a diameter smaller than the neck of the bottle (approximately half the diameter of the neck). The cartridge is dropped into the bottle, fitting very loosely therein, and is then held in place by being sandwiched between the cap and the bottom of the bottle when the cap is snapped in place over the lip of the bottle neck. This approach has several disadvantages. For example, wedging the cartridge between the cap and bottom of the bottle to maintain its position in the bottle creates a constant force on the inside of the cap tending to push it open. With the slight dimensional differences that can be anticipated in such inexpensive bottles (and cartridges), some caps may be expected not to close properly. Furthermore, since the cooling cartridge is narrow and is normally resting on the relatively wide convex inside bottom surface of the sports activity bottle, the bottom of the cartridge tends to slip to the side of the bottle. When the cartridge is thus tilted to the side of the bottle, at least two problems can occur. First, a greater direct contact between the wall of the cartridge and the exterior wall of the bottle wastes the cooling capacity of the cartridge. Additionally, for bottles that are stored on an angle while being carried (such as in most bicycle bottle holders), the cooling cartridge may inadvertently be disadvantageously tilted so as to be completely out of the liquid contained in the bottle, providing minimal or no cooling. Additionally, the basic cartridge shape is nearly cylindrical and, as discussed above, will be subject to strong expansive forces on the sides of the cylinder, possibly being sufficient to burst the cartridge, upon repeated freezing. The problems concerning lack of robustness under expansive forces can be further exacerbated if cartridge filling is not tightly controlled. Furthermore, since the positioning of the cartridge within the bottle requires a particularly tight fit between the inside of the cap and the inside bottom surface of the container, the cartridge cannot be generally utilized in a variety of sports bottles.

There are many beverage-cooling devices that constitute a container and coolant cavity manufactured as a self-contained unit. Some of these devices are described in the following U.S. Patent Nos.:

| Inventor | U.S. Pat. No. | Issue date |
|---|---|---|
| Glassman | 5,090,213 | Feb. 25, 1992 |
| Pimm et al. | 5,148,688 | Sept. 22, 1992 |
| Haas | 5,177,981 | Jan. 12, 1993 |
| Staggs | 5,271,244 | Dec. 21, 1993 |

They are far more expensive to manufacture and are more limited in use than sports bottles with cooling devices as considered herein. None of these devices can be used to cool a sports bottle and its beverage contents.

Another drawback seen in currently available cooling cartridges is the methods by which they are sealed in manufacturing after they have been filled with refrigerant. Two principal methods are employed to seal fill-openings: (1) plugs held in place with adhesive, and (2) sealing via ultrasonic welding. Both sealing techniques can fail. Refrigerant cartridges currently in the marketplace that have fill-openings sealed by the ultrasonic welding process have been known to leak refrigerant in use; additionally, the polyethylene plastics normally used for refrigerant cartridges and plugs cannot be effectively attached or fused with adhesives or solvents, rendering those approaches undesirable for sealing.

Finally, currently available cooling cartridges simply will not fit properly into a large percentage of the existing sports bottles.

There are also many cooling devices for use in cooling foods or beverages held in open containers. These devices, such as those disclosed by Faiola in U.S. Pat. No. 5,058,396, issued Oct. 22, 1991, and Coker in U.S. Pat. No. 5,235,823, issued Aug. 17, 1993, consist of plastic cartridges containing freezable substances. Faiola describes a hand-held cooling cartridge having a cross-shaped lower cross section, a shape already well established as being effective for heat transfer, to facilitate more rapid cooling than, for example, a cylindrical shape. Faiola further describes the need for a handle extension with which to hold the cartridge and manipulate it through the food or beverage in an open container to further facilitate cooling. Coker likewise describes a plastic cooling device for cooling a beverage in an open container and a handle on the device to allow manipulation of the device through the beverage, for example, by stirring. Coker further describes a "tapering body" or cartridge shape in which the volume of coolant contained within the cartridge increases at the lower end of the cartridge in order to keep a beverage cool more efficiently over time as the beverage level lowers due to consumption. As with Faiola, well-known surface shapes are used for the cooling cartridge to increase heat exchange. Coker and Faiola specify an integrated handle, or grasping area, as a part of the cooling cartridge. Cartridges used for chilling foodstuffs in open containers are designed to be manipulated through the chilled foodstuffs to enhance the cooling effect.

There are a variety of issues to consider in the design of cooling cartridges for sports bottles that have not been advantageously addressed in prior art designs. Despite the hundreds of beverage cooling systems available and the several billion sports bottles in use, there are no cooling devices that offer adequate cooling performance and a viable, commercially acceptable design for cooling beverages contained in sports bottles. Furthermore, all existing sports bottle/cooling cartridge combinations have significant performance drawbacks.

A need exists to provide an immersible cooling cartridge for a sports bottle that will cool beverages kept in the bottle more quickly than existing systems do and that will maintain a beverage contained in the bottle at a generally agreeable drinking temperature for the time needed for the consumption of the beverage.

A need exists to provide an immersible cooling cartridge for sports bottles that is easy to insert, remove, and clean.

A need exists to provide an immersible cooling cartridge that is more robust under the expansive forces created by a freezing refrigerant and that will allow a maximum filling level of coolant while accommodating additional expansive effects caused by inadvertent over-filling with refrigerant during manufacture.

A need exists to provide an immersible cooling cartridge with an improved shape that can be effectively incorporated into a wide variety of conventional sports bottles and that will maintain its position within those bottles for most effective cooling without depending on a special mount attachment or being wedged tightly between structural components of the bottle.

A need exists to provide an immersible cooling cartridge for which there is a quick and inexpensive means of sealing the refrigerant fill-opening.

A need exists to provide an immersible cooling cartridge that can be used in sports bottles having either an off-center drinking straw or a reclosable center spout for extraction of fluids from the bottle.

A need exists for an immersible cooling cartridge for sports bottles that addresses the above-mentioned needs and is also convenient to prepare and to transport in a separate insulated container.

A need exists to provide an immersible cooling cartridge that addresses the needs stated above and that can be easily mass produced at relatively low cost.

3. Solution to the Problem

The present invention provides a solution to the above problems by providing an immersible cooling cartridge formed from plastic having a side wall described by an alternating series of relatively larger radius concave surfaces and smaller radius convex ridges. This cross-sectional shape is translated longitudinally along the entire length of the cartridge forming a generally tubular shape. The convex ridges extend outward, thus providing a larger surface area for effective heat transfer and maintaining proper orientation of the cooling cartridge within the drinking container in which it is placed.

The concave surfaces of the cartridge side wall provide strength and resilience under internal expansive forces created by the freezing of refrigerant contained within the cooling cartridge. The radius of the concave surfaces is further designed to allow a drinking straw to extend from the top to the bottom of a drinking bottle while the cooling cartridge is in place.

The radius and area of the side wall create a cooling cartridge having both a relatively large surface area for an advantageous heat transfer rate and a total refrigerant volume advantageous in maintaining a chilled beverage in a sports bottle. The ratio of the surface area of the cartridge to its volume provides effective cooling for beverages contained in sports bottles.

The center portion of the top surface of the cooling cartridge is provided with a recessed area permitting fluid to be expelled through a centrally located exit spout of a sports bottle while the cooling cartridge is in place.

The cartridge is filled with refrigerant during manufacture and permanently sealed with a quick-insert, pressure-fit plug, thereby avoiding the use of adhesives or ultrasonic welding.

The trim, compact, tubular shape of the cooling cartridge allows easy transportation of extra cooling cartridges in an insulated container for recharging of the beverage container at remote locations.

Furthermore, the present invention also provides for cooling cartridges having a variety of wall shapes to address other special cooling needs for beverages carried in drinking bottles, for example, cartridge wall contours that taper from a smaller cross section at the proximal end to larger at the distal end, and in which the concave surfaces and convex ridges described above are replaced by essentially straight-line segments creating a regular closed geometric cross section with alternating outward- and inward-facing vertices, such as a four-pointed star shape or other more irregular shapes.

Finally, the present invention can be quickly and easily produced via mass production at a relatively low cost.

SUMMARY OF THE INVENTION

An immersible tubulate cooling cartridge for chilling liquids placed in a drinking bottle has a side wall shape that provides a balance of surface area and refrigerant volume for an advantageous combination of chilling rate and chilling duration. The side wall of the cooling cartridge comprises a plurality of spaced, axially disposed, longitudinal protrusions or convex ridges that are sized to enable the cooling cartridge of the present invention to be used in a wide variety of conventional beverage containers. The cooling cartridge comprises a recessed top surface that enables the cartridge to be used within drinking bottles having caps with centrally located drinking spouts. Concave surfaces of the cartridge side wall between the longitudinal concave surfaces also enable the cooling cartridge to be used within drinking bottles that have a drinking straw placed through an off-center hole in the bottle cap for extraction of the beverage. The longitudinal concave surfaces of the cooling cartridge also provide strength against internal expansive forces created when a contained refrigerant is frozen and provide expansive relief should such internal pressure become excessive. The cooling cartridge is designed to contain a variety of nontoxic refrigerant materials, such as water, various gels, or other refrigerants. The cartridge is easy to fill with refrigerant through a fill-hole on its top surface and is provided with a rapid-insertion, pressure-fitting plug to plug the fill-hole.

BRIEF DESCRIPTION OF THE DRAWING

FIG. 5(*b*) is a side cross-sectional view showing a cooling cartridge of the present invention in a plastic drinking bottle;

FIG. 5(*c*) is a top view of a cooling cartridge of the present invention in a plastic drinking bottle;

FIG. 5(*d*) is a side cross-sectional view of the position of a cooling cartridge of the present invention when the drinking bottle is in a tilted position;

FIG. 6(*b*) is a top elevational view and FIG. 6(*c*) is a side cross-sectional view showing the use of a cooling cartridge of the present invention with a drinking bottle having a cap utilizing an off-center mounted drinking straw;

DETAILED DESCRIPTION OF THE INVENTION

Figure 1:
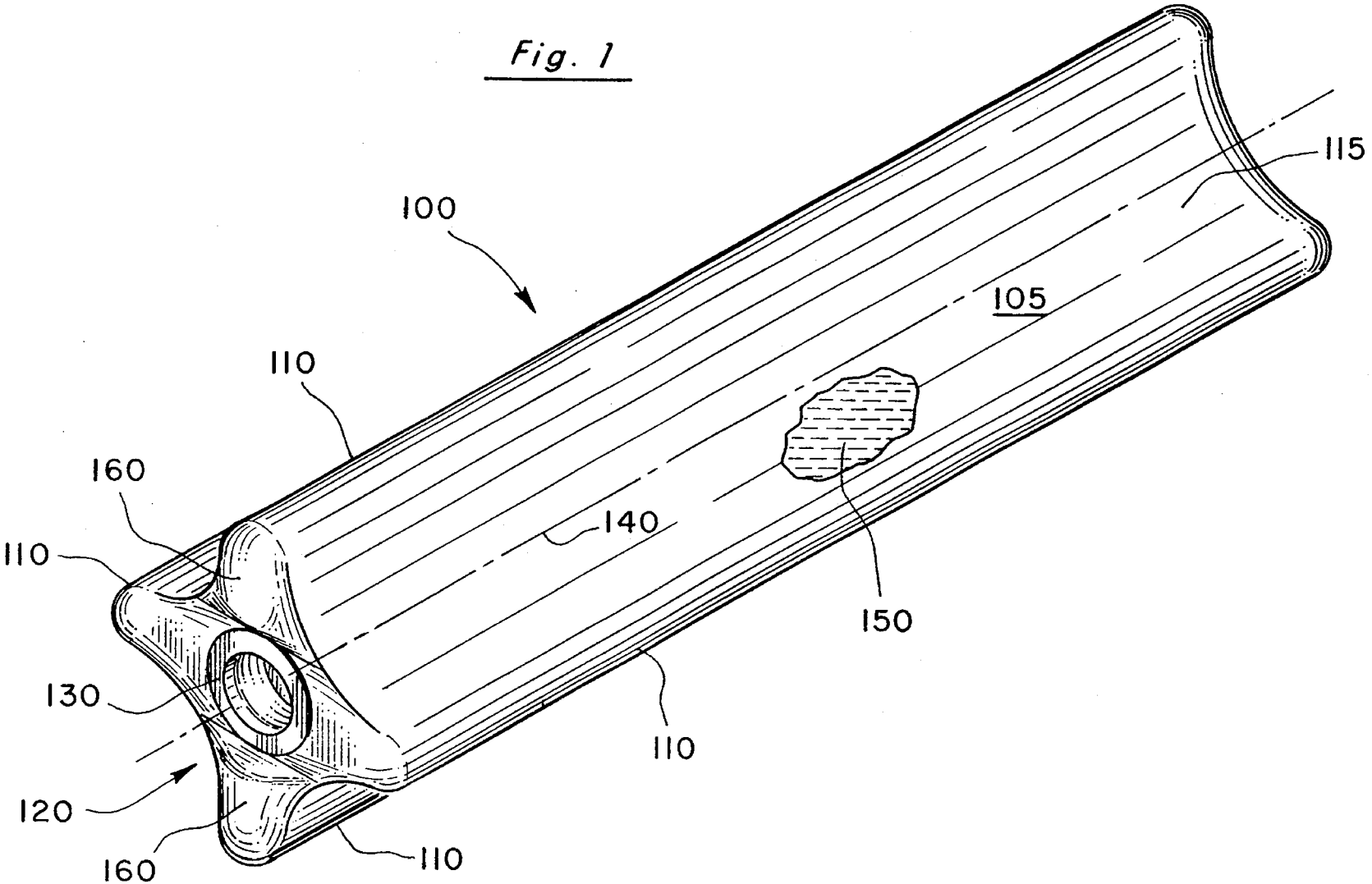
FIG. 1 is a perspective view of a cooling cartridge of the present invention.
Figure 2:
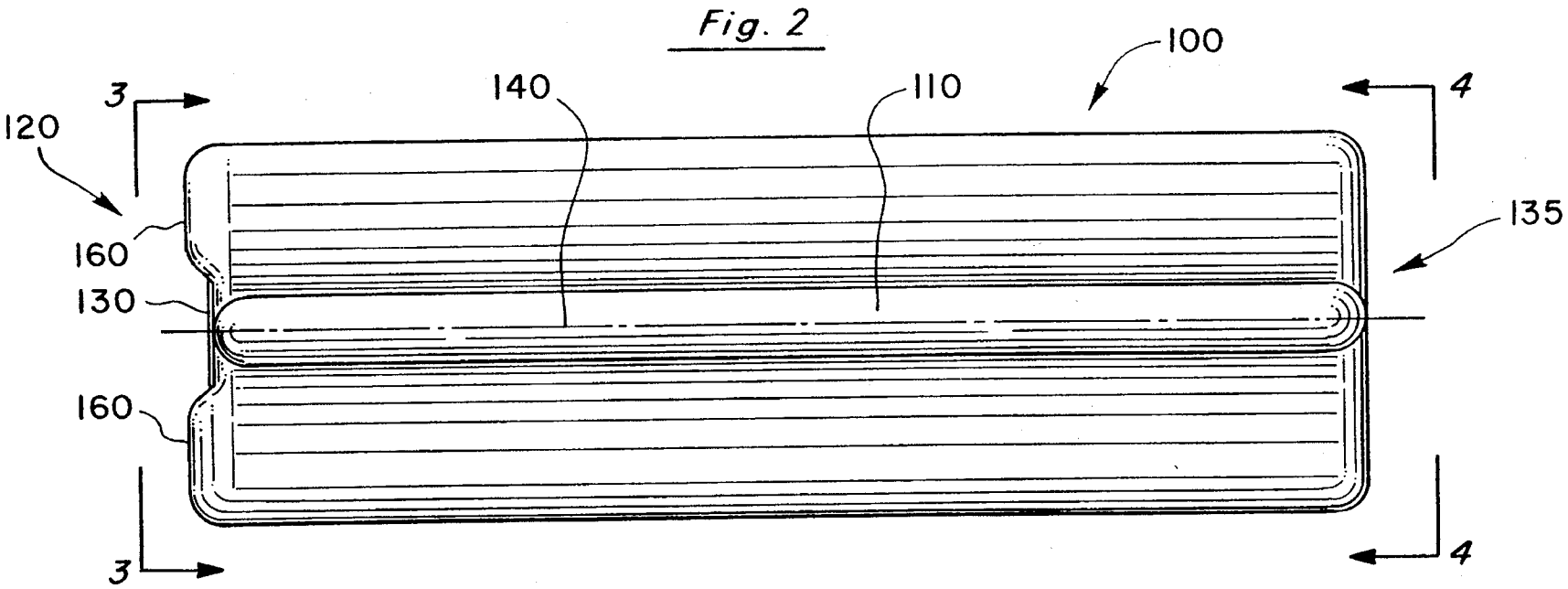
FIG. 2 is a side elevational view of a cooling cartridge of the present invention.
Figure 4:
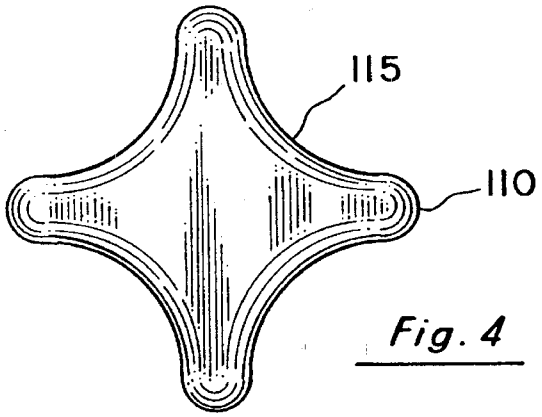
FIG. 4 is a bottom elevational view of a cooling cartridge of the present invention.

As can be seen in FIG. 1, the immersible cooling cartridge 100 of the present invention has an elongated, substantially tubular shape with a tubulate side wall 105, a top surface 120, and a bottom surface 135 together enclosing a closed interior cavity 150. A fill-hole plug 130 is located in the top surface 120 of the cooling cartridge 100. The closed interior cavity 150 of the cooling cartridge 100 is filled with a refrigerant 200, typically to about 90 percent of the available volume of the interior cavity 150, and the refrigerant 200 is then sealed within the interior cavity 150. The cartridge 100 is typically manufactured from a plastic material, for example, high-density polyethylene (HDPE), having good thermal transfer characteristics and is fabricated having a thin side wall 105, typically less than 0.06 inch, to provide excellent heat transfer for maximal cooling.

As shown in FIG. 1, the tubulate side wall 105 comprises a plurality of smaller radius longitudinal protrusions or convex ridges 110, with each pair of longitudinal protrusions 110 separated by a larger radius longitudinally extending concave surface 115. The longitudinal concave surfaces 115 define the longitudinal protrusions 110 that extend the length of the cartridge 100 from the top surface 120 to the bottom surface 135. The longitudinal protrusions 110 are arranged in a radial pattern about the central axis 140 of the cooling cartridge 100. In the preferred embodiment shown in FIGS. 1 through 4, a total of four radially arranged longitudinal protrusions 110 form a substantially X-shaped pattern about the central axis 140 of the cooling cartridge 100.

The longitudinal protrusions 110 form narrow vanes containing refrigerant 200 and have a large surface area of contact with the liquid in which the cooling cartridge 100 is immersed. The protrusions 110 function as fins, initiating a rapid cooling process when a liquid is first added to a drinking bottle 500 and a frozen cartridge 100 is immersed in the liquid. The interior cavity 150 of the cooling cartridge 100 provides for a compact volume of refrigerant 200 sufficient to maintain a satisfying cooling effect in a non-insulated drinking bottle 500 in an environment with a relatively high ambient temperature for a duration normally considered acceptable for consumption of the liquid within the drinking bottle 500. The cooling cartridge 100 of the present invention can provide the equivalent effective cooling, as discussed below, of a conventional cylindrical cooling cartridge having a significantly larger volume.

Figure 8:
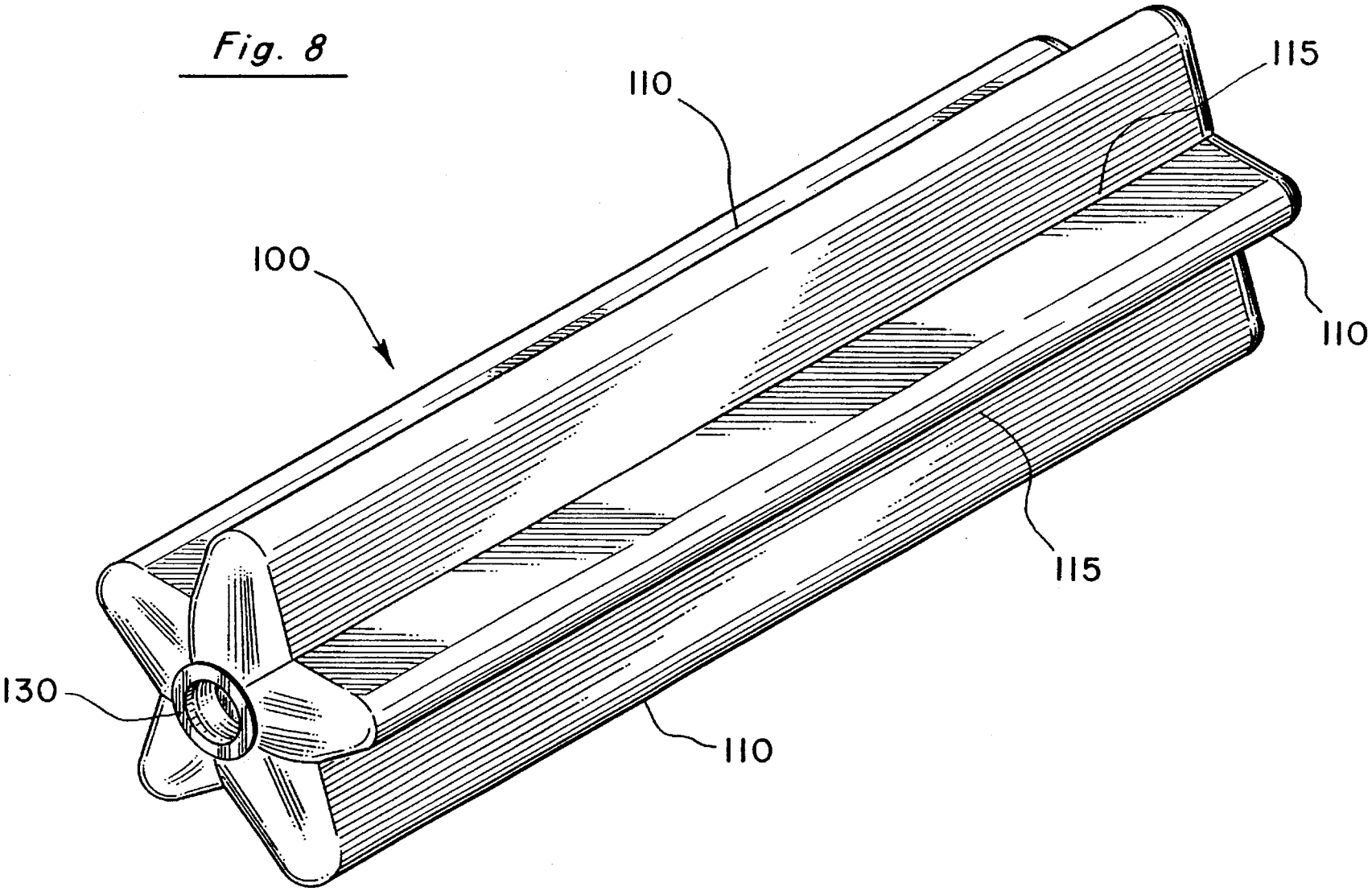
FIG. 8 shows an alternative embodiment of a cooling cartridge of the present invention.
Figure 9:
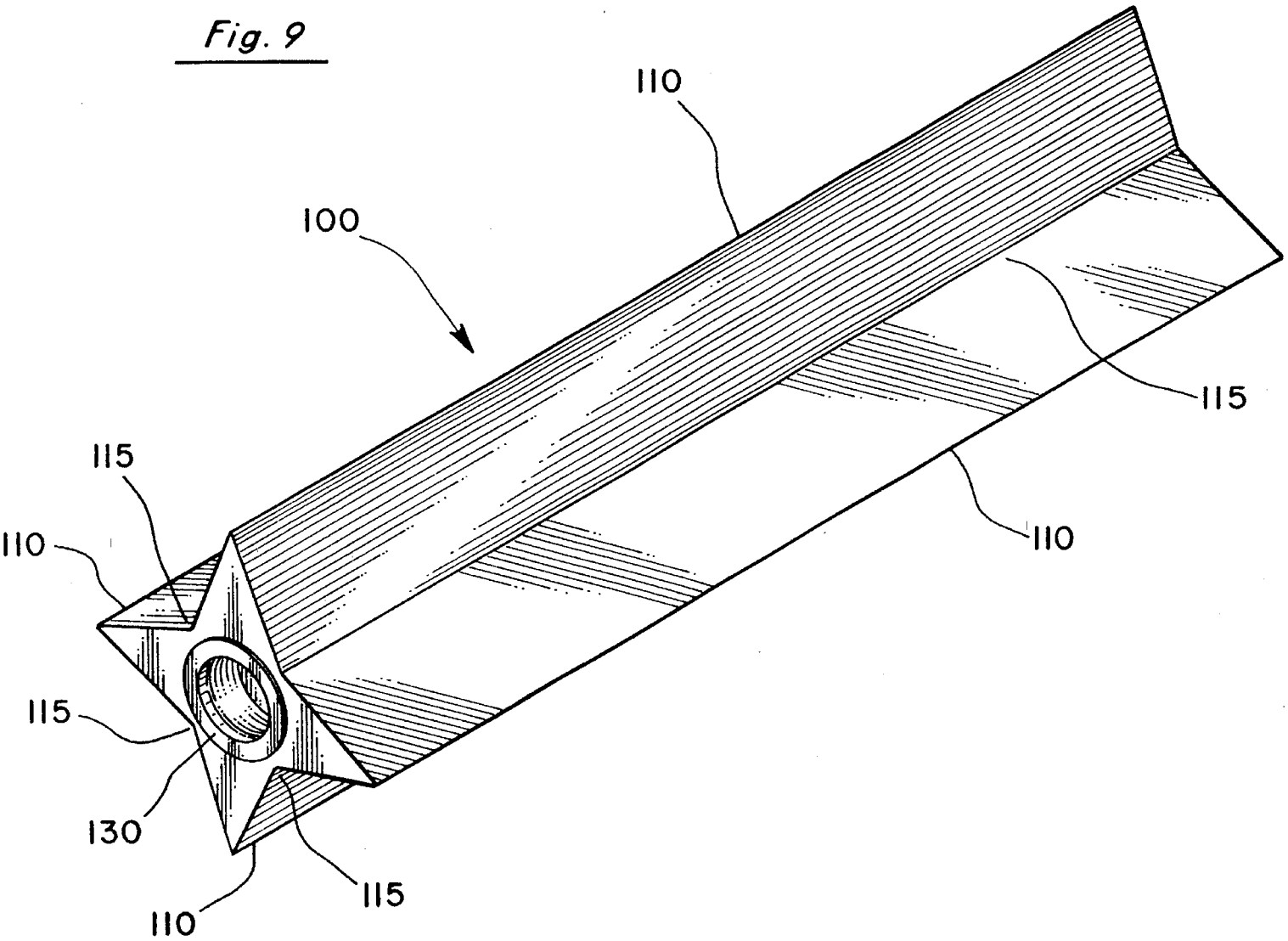
FIG. 9 shows a third embodiment of a cooling cartridge of the present invention.
Figure 10:
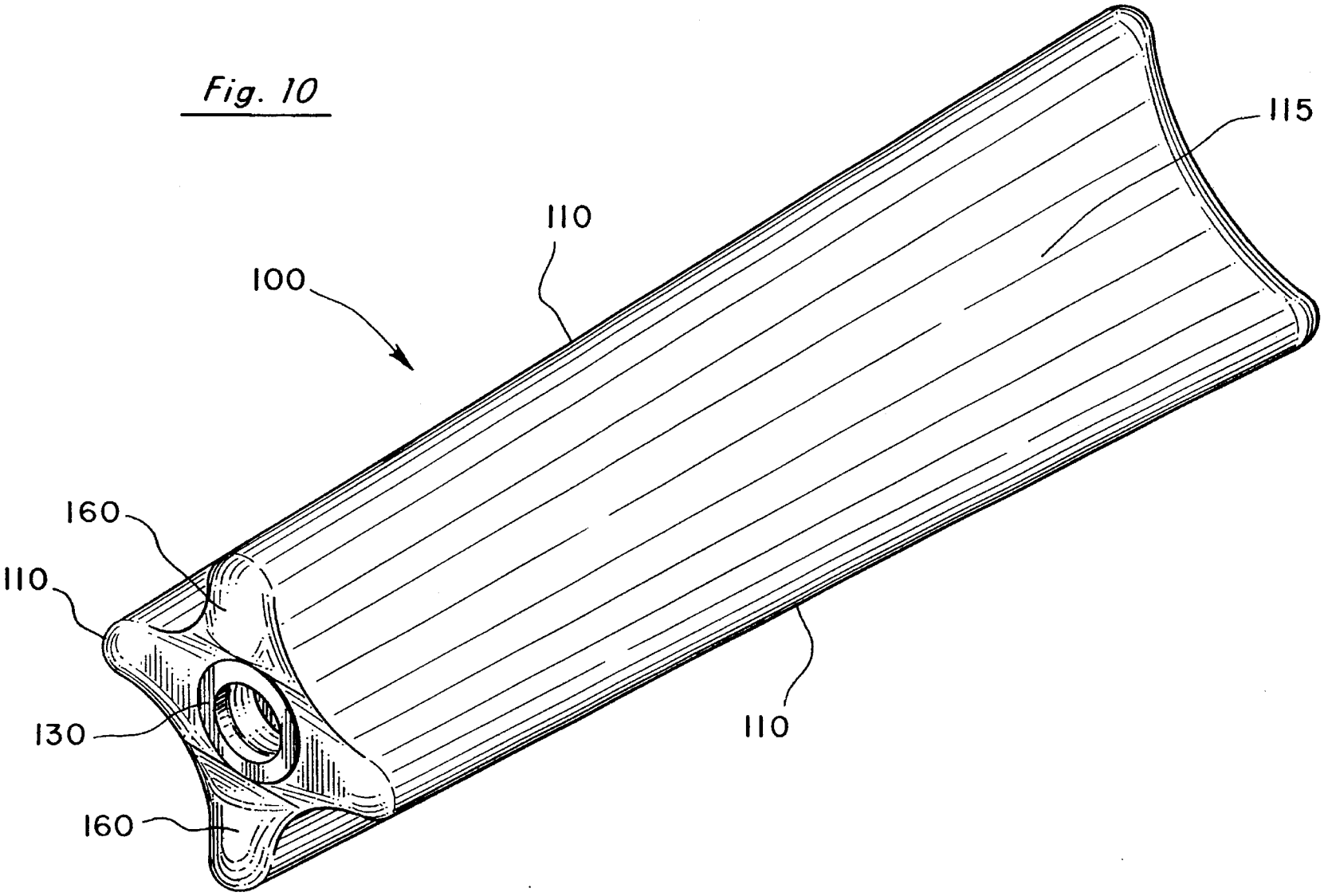
FIG. 10 shows yet another embodiment of the cooling cartridge of the present invention.

The tubulate side wall 105 shape of the cooling cartridge 100 creates an advantageous surface area/volume relationship (SA/V) greater than 2.75 for effective cooling performance. Calculation of SA/V ratios typically includes the cartridge side wall 105 surface area and bottom surface 135 area only. It is to be expressly understood that other cooling cartridges having side wall contours yielding desirable SA/V ratios, resilience under expansive forces, and orientation stability without additional mounting requirements are anticipated under the teachings of the present invention and that the present invention is not to be limited to the description of the preferred embodiment herein. Thus, any number of longitudinal protrusions 110 and concave surfaces 115 could be utilized to form the cartridge side wall 105, as shown in FIG. 8 for a cooling cartridge 100 with five protrusions 110. Or, for example, the longitudinal protrusions 110 and concave surfaces 115 of the side wall 105 of the present invention could be replaced by straight segments connecting at angular vertices. One such embodiment, shown in FIG. 9, having a four-pointed star-shaped cross-sectional appearance, provides a large surface area/volume ratio within a cooling cartridge embodiment appropriately used within the tall, narrow container cavity of an activity sports bottle. In addition, the cooling cartridge 100 could have a shape that is smaller in cross section near the top surface 120 and that gradually increases in cross section near the bottom surface 135, forming a tapered cartridge, as shown in FIG. 10, and providing for greater cooling capacity near the bottom surface 135 of the cartridge 100, the bottom surface 135 being more likely to remain immersed in liquid as the level of liquid decreases through consumption.

Figure 3:
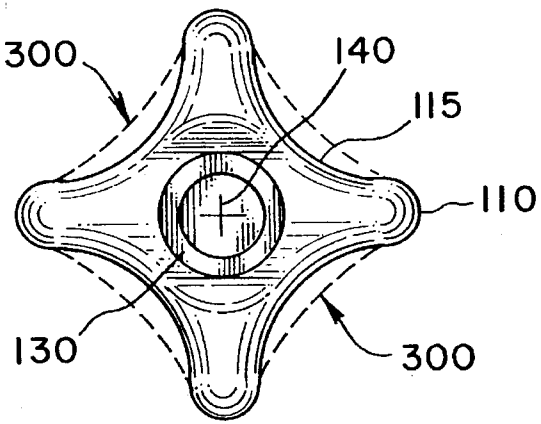
FIG. 3 is a top elevational view of a cooling cartridge of the present invention.

FIG. 3 depicts the movement 300 of the side wall 105 of the cartridge 100 under the influence of internal expansion forces. Upon freezing of the refrigerant 200 contained within the interior cavity 150 of the cooling cartridge 100, the longitudinal concave surfaces 115 of the tubulate side wall 105 move outward toward new positions as indicated by the dotted lines 300, accommodating the internal expansion of the refrigerant 200 upon freezing and thereby reducing stress on the plastic material of the side wall 105. Such side wall movement 300 under internal expansion pressures is reversible, and the concave surfaces 115 of the cartridge 100 return to their original concave contour upon thawing of the refrigerant 200. This resilience under expansive forces is particularly important since, as is well known, most refrigerants 200 expand significantly upon freezing. Typically, a cooling cartridge 100 of the present invention is filled with refrigerant 200 to about 90 percent of its available volume, thereby leaving a modicum of space within the cartridge 100 for expansion. However, expansion on freezing takes place in all directions simultaneously and often longitudinal movement is minimal. Furthermore, the normal manufacturing process of filling the cartridges 100 with the refrigerant 200 can be an inexact process, and overfilling is not uncommon. The strength and resilience created by the concave contoured shape of the side wall 105 of the cartridge 100 further enables the use of a very thin plastic to manufacture the cartridge 100, thereby providing for greater heat transfer and lower cost.

Many types of refrigerants 200 may be utilized in conjunction with the cartridge 100 of the present invention. Typically, water, aqueous solutions of sodium chloride, or gel-based substances such as sodium polyacrylate or N-acrylamide bound with starch or carboxymethyl cellulose are used as refrigerants 200. It is recommended that a refrigerant 200 having a freezing point at, or only slightly lower than, that of water (32 degrees Fahrenheit) be utilized to keep the liquid in the drinking bottle 500 acceptably cool while minimizing the temperature differential between the chilled liquid and the ambient environment. Nontoxic refrigerants should always be employed.

Figure 5A:
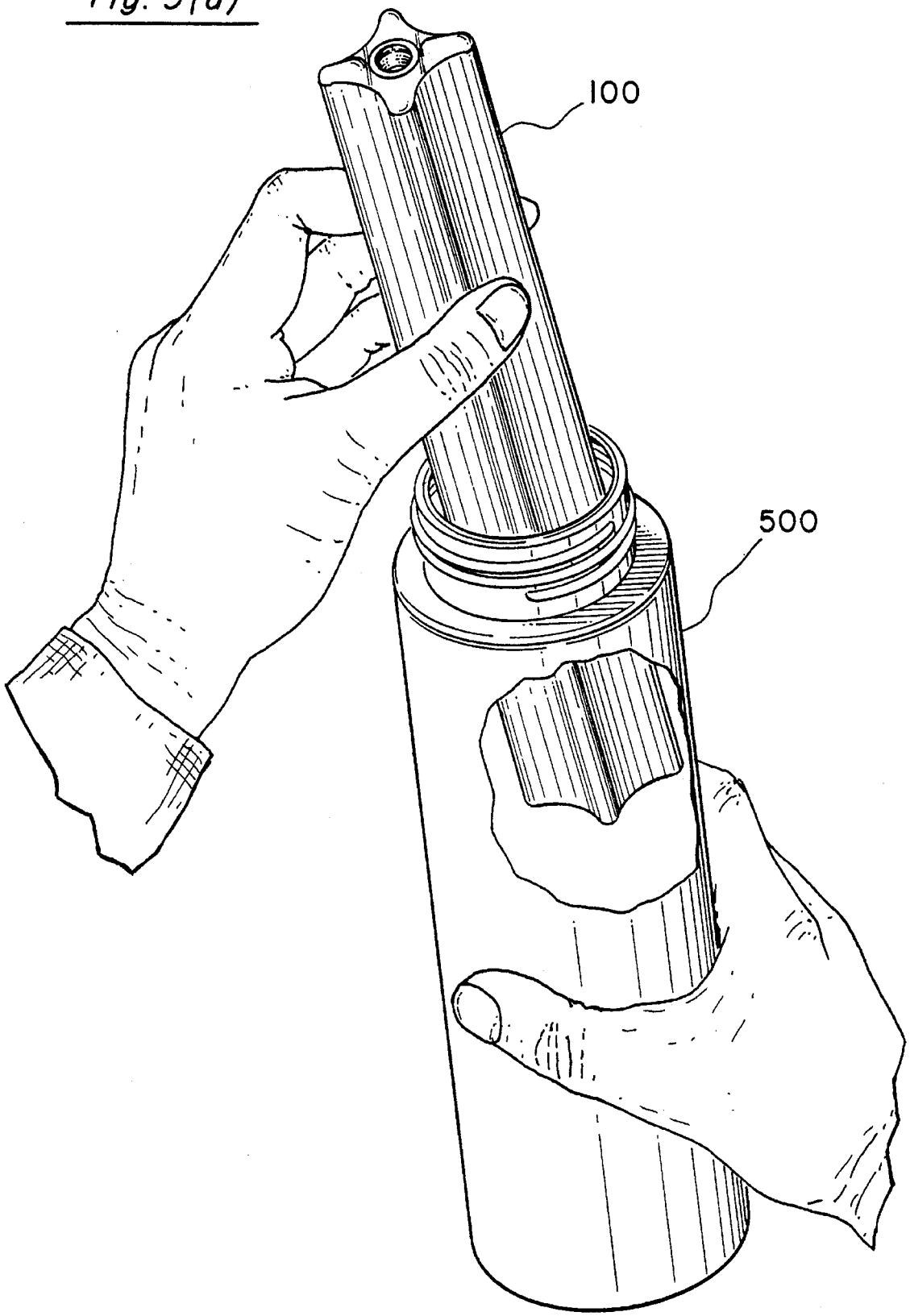
FIG. 5(*a*) is a perspective view of a cooling cartridge of the present invention being inserted into a plastic drinking bottle.
Figure 5D:
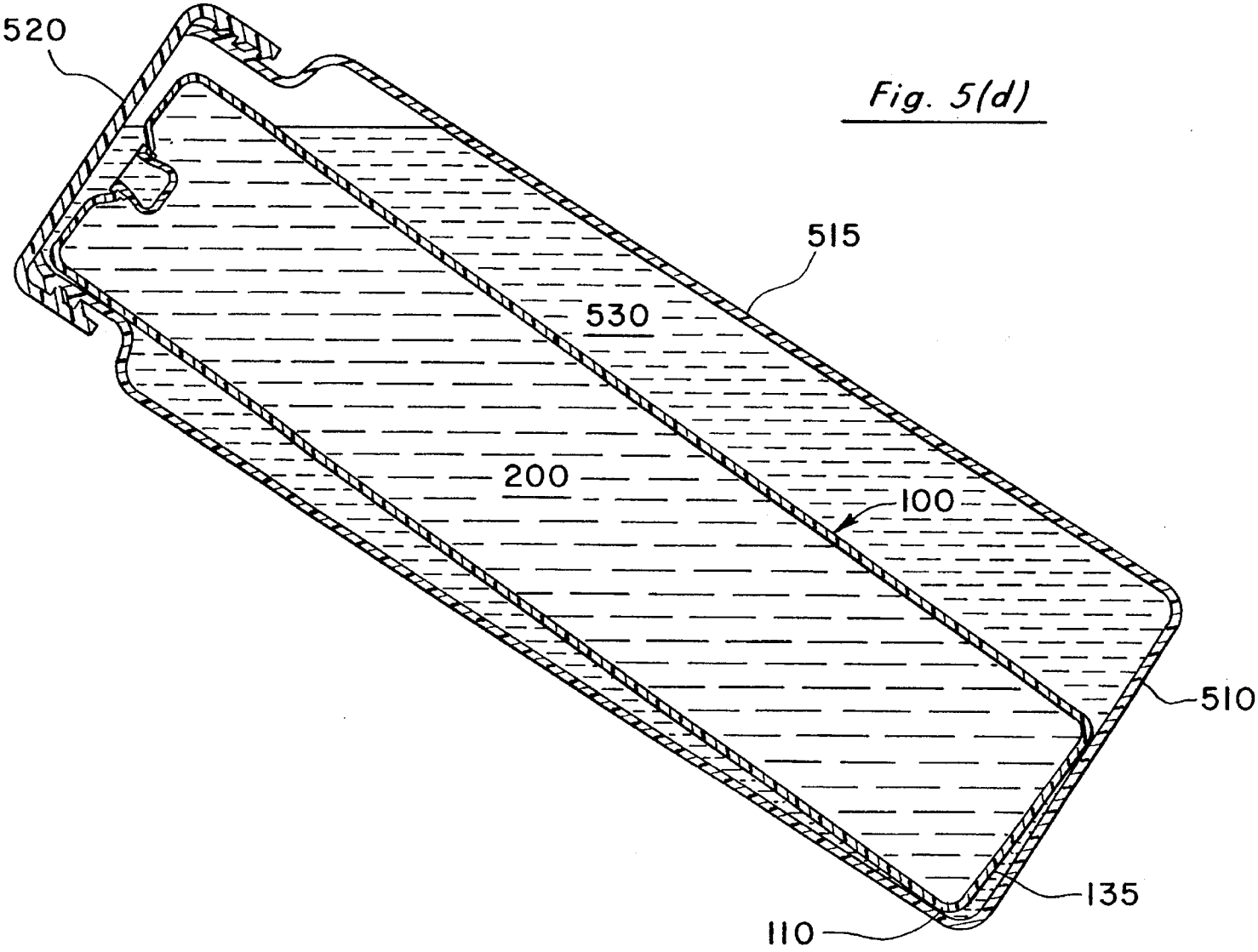

In use, the cooling cartridge 100 containing a desired refrigerant 200 is first prepared by freezing and is then inserted into the drinking bottle 500 via the tubulate mouth of the bottle 500 as shown in FIG. 5(*a*). The shape of the cartridge 100 makes it easy to grasp when it is inserted into or removed from a drinking bottle 500. The radial pattern formed by the longitudinal protrusions 110, as described above, has sufficiently small dimensions to pass through the circular mouth of the drinking bottle 500. The drinking bottle 500 is then filled to the desired level with a liquid 530, and a cap 520 is twisted on tightly. When a cap 520 with an off-center hole 525 is used, a straw 610 is typically inserted through the hole 525 before the cap 520 is attached to the drinking bottle 500. The cooling cartridge 100 rotates easily, in a turnstile manner, within the drinking bottle 500 under the rotational force transmitted by the straw 610 pushing against one of the longitudinal protrusions 110 of the cooling cartridge 100 when the cap 520 is tightened (or loosened). When the cap 520 is fully tightened on the drinking bottle 500, the cartridge 100 within will substantially span the predetermined interior height between the bottom 510 of the drinking bottle 500 and the underside of the cap 520, maintaining cartridge 100 orientation within the drinking bottle 500 while the bottle 500 is in use, as shown in more detail in FIGS. 5(*b*), 5(*c*), and 5(*d*).

FIG. 5(*b*) shows the cartridge 100 fitting snugly within the interior height of the drinking bottle 500. The height of the cooling cartridge 100 is designed to be slightly less that the predetermined interior height of the drinking bottle 500. It can be seen that the top surface 120 of the cartridge 100 is in close proximity to the inner surface of the cap 520 of the drinking bottle 500, while the bottom surface 135 of the cartridge 100 is in contact with the inner bottom surface 510 of the drinking bottle 500. This tight fit prevents any substantial vertical movement of the cooling cartridge 100 within the drinking bottle 500.

FIG. 5(*c*) shows how the longitudinal protrusions 110 further stabilize the orientation of the cooling cartridge 100 within the drinking bottle 500. Typically, when the cooling cartridge 100 is inserted into the drinking bottle 500, the bottom surface 135 of the cooling cartridge 100 rests on the inside bottom surface 510 of the drinking bottle 500 and, concurrently, one or two longitudinal protrusions 110 of the cartridge 100 rest against, or are in close proximity to, the inside of the neck 505 of the drinking bottle 500, thereby maintaining a secure orientation toward the vertical midline of the drinking bottle 500 without the need for additional bracketing or mounting components. As discussed above, standard convenience bottles are manufactured having one of three neck diameters: 63 mm, 70 mm, or 80 mm. A cooling cartridge 100 of the present invention manufactured to fit snugly within a drinking bottle 500 having a 63-mm neck diameter will also substantially span the neck of a drinking bottle 500 having a neck diameter of 80 mm and will maintain its proper orientation. Orientation of the cartridge 100 toward the vertical midline of the drinking bottle 500 provides for the most effective chilling of the liquid 530 contained in the bottle 500. Furthermore, the protrusions 110 maintain minimal direct contact between the side wall 105 of the cartridge 100 and the side wall 515 of the bottle 500 under all usual drinking bottle 500 orientations, minimizing ineffective heat transfer. It is to be expressly understood that generally tubular cooling cartridges having longitudinal protrusions of different number or contour can maintain the proper orientation without needing additional mounting apparatus or fixtures and that such cooling cartridge embodiments are anticipated by the present invention.

FIG. 5(*d*) shows the cartridge 100 within the drinking bottle 500 containing the liquid 530 and having the cap 520 in place with the drinking bottle 500 being tilted to one side. The cooling cartridge 100 has an overall length substantially spanning, but slightly shorter than, the interior height of the drinking bottle 500 between the cap 520 and the bottom 510. (Note that the cartridge 100 is buoyant in the liquid 530 and floats within the bottle 500.) The protrusions 110 of the cartridge 100 generally maintain the orientation of the cartridge 100 toward the vertical midline of the drinking bottle 500, exhibiting only minimal direct surface area contact between the side wall 105 of the cartridge 100 and the side wall of the drinking bottle 500 when the bottle 500 is in a nonvertical position. Since a large percentage of existing convenience bottles differ in height by 15 mm or less and in neck diameter by 17 mm or less, it can be readily seen that the cartridge 100 fabricated to fit snugly into a drinking bottle 500 manufactured having the smaller set of standard dimensions as described above can be utilized effectively within existing convenience bottles manufactured from the larger set of dimensions and within those of in-between dimensions.

Figure 6A:
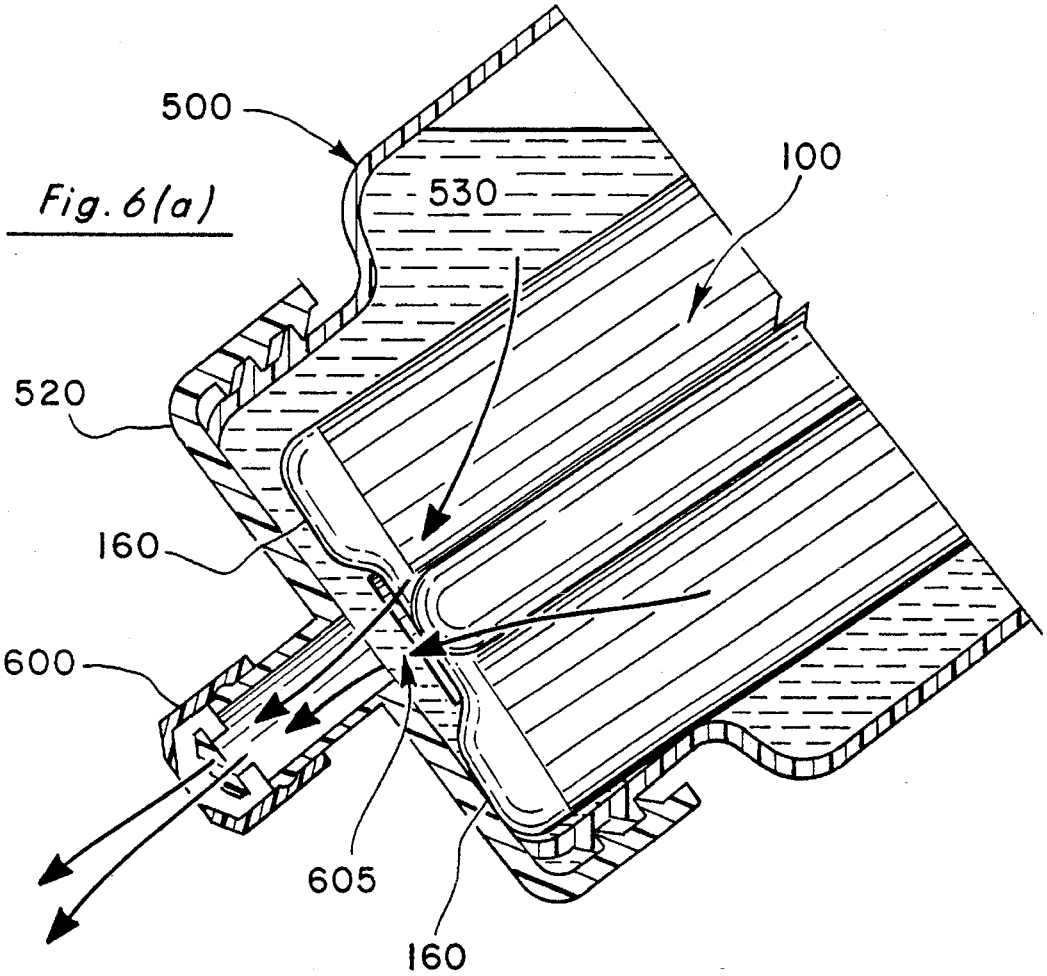
FIG. 6(*a*) is a side cross-sectional view illustrating the fluid exit passageway provided by the recessed top of a cooling cartridge of the present invention when used in conjunction with a drinking bottle having a centrally located spout on the cap of the bottle.
Figure 6B:
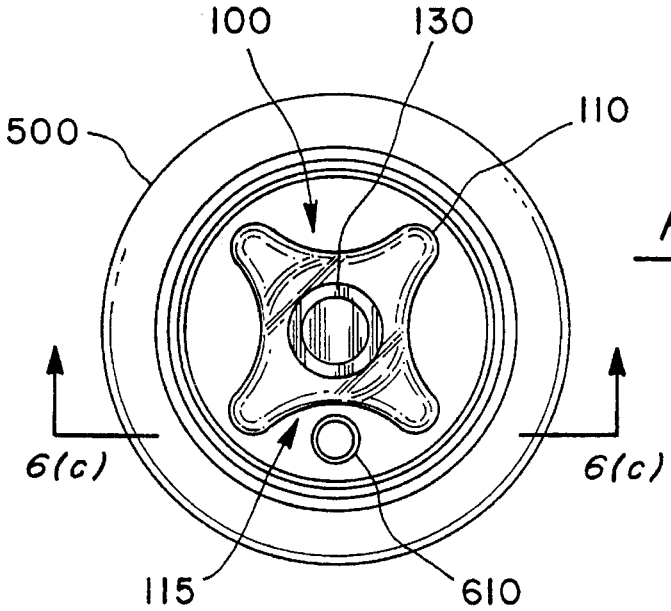
Figure 6C:
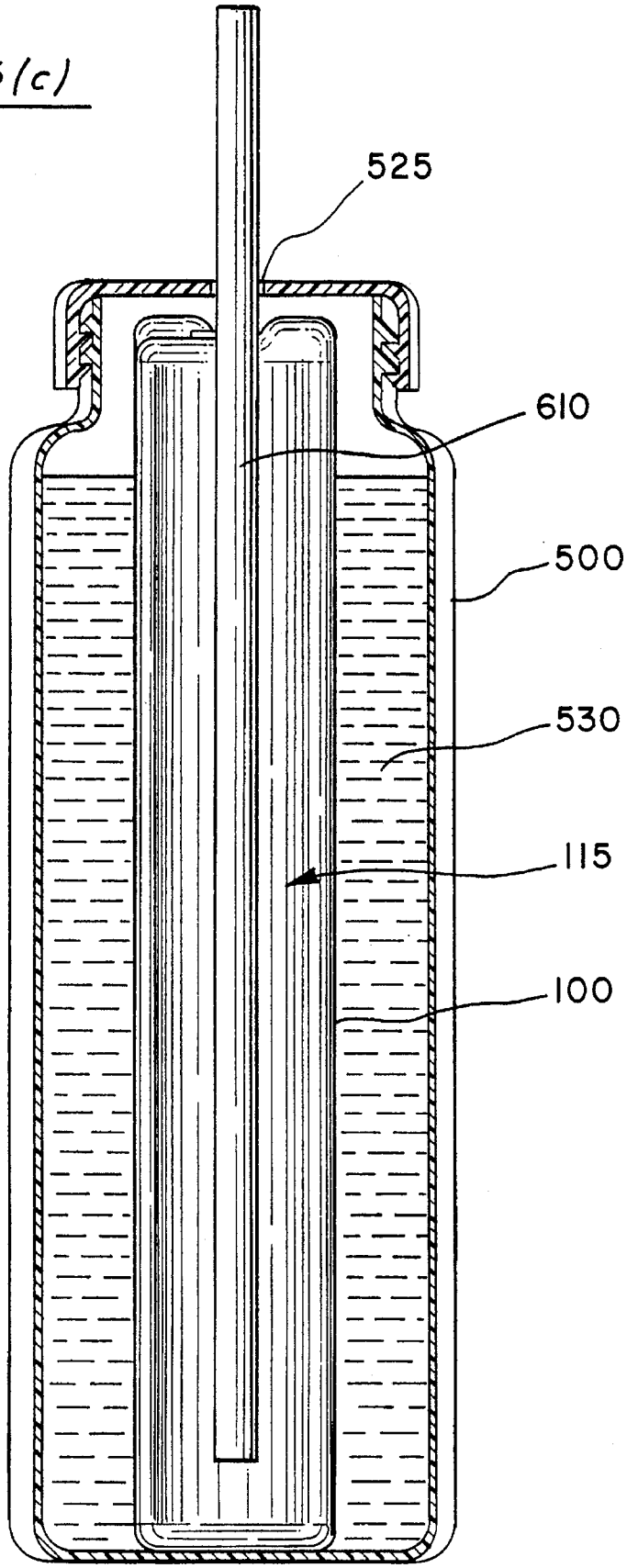
Figure 7A:
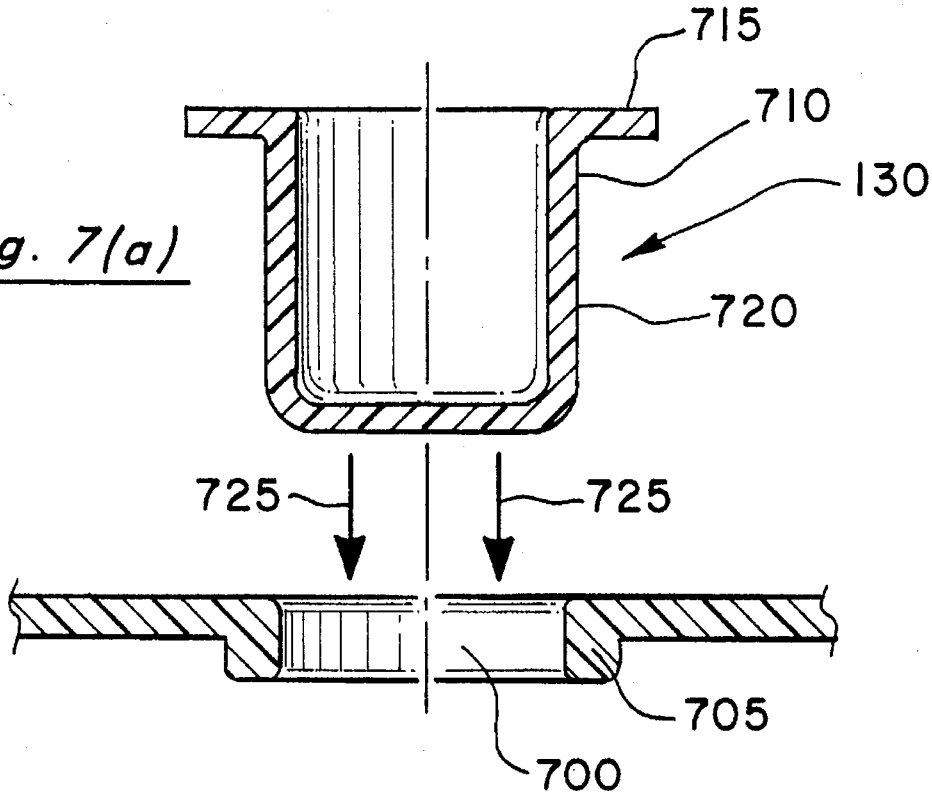
FIGS. 7(*a*) and 7(*b*) illustrate the insertion of a plug into the fill-hole of a cooling cartridge of the present invention.
Figure 7B:
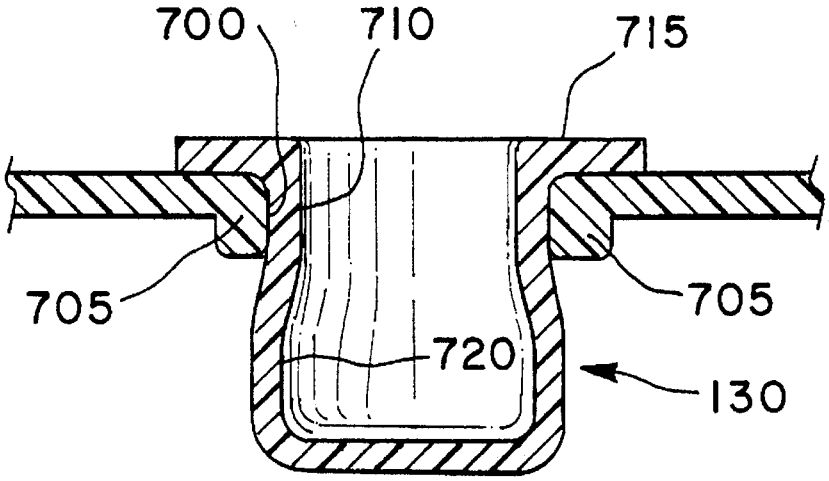

FIG. 6(*a*) shows the cooling cartridge 100 utilized in conjunction with a drinking bottle 500 with a cap 520 having a valved drinking spout 600 in the center of the cap 520. An exit channel 605 is provided between the interior cavity 535 of the drinking bottle 500 and the exit channel 605 of the drinking spout 600 via the recessed area 125 of the top surface 120 of the cartridge 100. The recessed area 125 of the cartridge 100 is created by extending at least one of the longitudinal protrusions 110 of the cartridge 100 slightly above the top surface 120 of the cartridge 100 to form a raised vertical protrusion 160. A fill-hole 700 and a plug 130 are disposed within the lower, flat portion of the top surface 120, as shown in FIGS. 1 and 7. In use, the raised protrusion 160 maintains an open fluid passageway 605 between the interior cavity 535 of the drinking bottle 500 and the drinking spout 600 under all physical orientations of the drinking bottle 500.

FIGS. 6(*b*) and 6(*c*) show the cooling cartridge 100 utilized in conjunction with a drinking bottle 500 having a cap 520 with a drinking straw 610 extending through the hole 525 in the cap 520 for extraction of the liquid 530 from the drinking bottle 500. FIG. 6(*b*), with the cap 520 removed, shows the straw 610 within the space between two adjacent longitudinal protrusions 110 of the cooling cartridge 100. Another view of the orientation of the straw 610 within a drinking bottle 500 also containing a cartridge 100 is shown in FIG. 6(*c*).

The cartridge 100 is typically completely immersed in the liquid 530 that it is designed to chill. It is therefore very important that no refrigerant 200 be able to leak from the cartridge 100. Although the refrigerant 200 used in the cartridge 100 is nontoxic, many nontoxic refrigerants 200 have unsatisfactory flavors and appearances that, if allowed to migrate into a beverage, could spoil beverage flavor and texture and be aesthetically undesirable. As stated above, the conventional sealing techniques of ultrasonic welding, gluing, or solvent fusing of a plug are all inappropriate for sealing the refrigerant fill-hole 700 of the cartridge 100. The cartridge 100 of the preferred embodiment of the present invention is typically manufactured from HDPE. A fill-hole 700 is placed within the recessed area 125 of the top surface 120 of the cartridge 100 and is used to fill the cartridge 100 with the refrigerant 200. As shown in FIGS. 7(*a*) and 7(*b*), the fill-hole 700 has a reinforcing thickness about its perimeter 705, causing the plastic material to be very rigid about the perimeter 705. The plug 130 has a circular rim 715 and a cylindrical body with a side wall 720 and a neck area 710 between the rim 715 and the side wall 720. The plug 130 is manufactured from a softer polyethylene material than that of the cartridge 100. The plug 130 is manufactured to have a diameter slightly larger (about 0.02 inch to 0.03 inch larger) than the inside diameter of the fill-hole 700.

During manufacturing, the cartridge 100 is filled with the desired amount of refrigerant 200 and the plug 130 is then inserted in the fill-hole 700 as shown in FIGS. 7(*a*) and 7(*b*) by pressing the plug in the direction shown by the arrows 725 into the fill-hole 700 until the rim 715 of the plug 130 is flush with the top surface 120 of the cartridge 100. When the plug 130 is press-fitted into the fill-hole 700, the side wall 720 of the plug 130 deforms to accommodate the shape and size of the fill-hole 700 as shown in FIG. 7(*b*). The resultant constriction of the neck 710 by the fill-hole perimeter 705 creates a harpoon-like attachment permanently affixing the plug 130 into the fill-hole 700. Alternatively, the plug 130 can be manufactured having a circular groove about the neck 710 of the plug 130 into which the perimeter 705 of the fill-hole 130 is seated during assembly. Also, the plug 130 can be manufactured having a circular ridge below the neck 710 of the plug 130 to capture the perimeter 705 between the ridge and the underside of the rim 715 when the plug 130 is inserted fully into the fill-hole 700. Use of a groove or ridge as described above creates an even stronger attachment holding the plug 130 within the fill-hole 700. Additionally, the fill-hole 700 and the plug 130 could be provided with compatible threads for a twist-on connection. However, appropriate conventional plugs currently exist for implementing the preferred embodiment described above and shown in FIGS. 7(*a*) and 7(*b*). Hence, the preferred embodiment may be expected to provide the lowest cost approach while also providing adequate, permanent attachment of the plug 130 into the cooling cartridge 100. The pressure-fitting plug 130 provides a safe, easy, cost-effective manner with which to seal the cartridge 100 without requiring the extra manufacturing step of ultrasonic welding or the extra step and additional materials required for gluing. It is to be expressly understood that the relative diameters discussed above between the plug 130 and the fill-hole 700 are general guidelines. Different embodiments employing differing designs, such as a plug and/or fill-hole having tapered or ribbed walls or made of different materials, or having different thicknesses of materials than described above, may require different relative sizes than the ranges suggested above in order to seal the fill-hole 700 and are contemplated under the present invention.

The cooling cartridge 100 of the present invention can be inserted within a conventional pinched-bottom, or cup-holder, type of drinking bottle (not shown). A pinched-bottom drinking bottle comprises a generally cylindrical body having a lower cylindrical section of a smaller diameter to fit into standard cup and bottle holders, such as those commonly found in automobiles and boats. The cooling cartridge 100 of the present invention fits easily into the reduced-diameter portion of a conventional pinched-bottom or cup-holder drinking bottle. It can therefore be seen that the cooling cartridge 100 manufactured in one set of conventional dimensions can be utilized for cooling liquids contained in any one of several billion drinking containers. Typical dimensions for the cooling cartridge 100, for illustration purposes, are: a span of 2.05 inch across opposing longitudinal protrusions 110, a length from the top surface 120 (of the raised vertical protrusion 160) to the bottom surface 135 of 8.5 inch, a longitudinal protrusion 110 radius of about 0.18 inch, and a concave surface 115 radius of about 0.75 inch. An appropriate recess 125 of about 0.15 inch from the end of the vertical raised protrusion 160 to the remaining flat area of the top surface 120 is sufficient to create a fluid channel 605 for drinking bottles 500 having caps 520 with a center drinking spout 600. The above-described dimensions produce a cooling cartridge 100 having a volume of about 7 oz. The resultant effective volume of freezable refrigerant 200, about 6.5 oz., within the cooling cartridge 100 is sufficient for use in conventional drinking bottles for keeping liquids within the bottle suitably cool for typical consumption periods even in warm ambient environments.

The invention has been described with reference to the preferred embodiment. Modifications and alterations will occur to others upon a reading and understanding of this specification. This specification is intended to include all such modifications and alterations insofar as they come within the scope of the appended claims or the equivalents thereof.

I claim:

1. A combination drinking bottle and internal cooling cartridge comprising:

a cooling cartridge having:

(a) a top surface and a bottom surface, said top surface having at least one raised vertical protrusion;

(b) a tubulate side wall extending between said top surface and said bottom surface having a plurality of longitudinal protrusions, each adjacent pair of said longitudinal protrusions being separated by a longitudinally extending concave surface;

(c) a closed interior cavity within said cooling cartridge surrounded by said side wall, top surface, and bottom surface; and (d) a refrigerant sealed within said interior cavity; said cooling cartridge having a predetermined height; and a drinking bottle having:

(a) an interior cavity for containing a quantity of a beverage and said cooling cartridge;

(b) a tubulate mouth sufficiently large to permit said cooling cartridge to be inserted through said mouth into said interior cavity of said drinking bottle, said mouth also providing lateral support for a portion of said side wall adjacent to said top surface of said cooling cartridge to maintain said cooling cartridge in a substantially vertical orientation within said bottle; and (c) a cap for removably sealing said mouth and having an opening for drinking;

said raised vertical protrusion of said top surface allowing said beverage within said interior cavity of said drinking bottle to flow freely past said cooling cartridge and through said opening in said cap;

said cavity of said drinking bottle having a predetermined height, wherein the height of said cooling cartridge is slightly less than said height of said cavity to prevent substantial vertical movement of said cooling cartridge within said drinking bottle.

2. The combination drinking bottle and internal cooling cartridge of claim 1 wherein said longitudinal protrusions of said cooling cartridge comprise convex ridges.

3. The combination drinking bottle and internal cooling cartridge of claim 1 wherein said longitudinal protrusions of said cooling cartridge are arranged in a radial pattern about a central axis.

4. The combination drinking bottle and internal cooling cartridge of claim 3 wherein four longitudinal protrusions form a substantially X-shaped pattern about said central axis.

5. A combination drinking bottle and internal cooling cartridge comprising:

a cooling cartridge having:

(a) a tubulate side wall having a plurality of longitudinal protrusions, each adjacent pair of said longitudinal protrusions being separated by a longitudinally extending concave surface;

(b) a closed interior cavity within said cooling cartridge surrounded by said side wall, top surface, and bottom surface; and (c) a refrigerant sealed within said interior cavity; said cooling cartridge having a predetermined height; and a drinking bottle having:

(a) an interior cavity for containing a quantity of a beverage and said cooling cartridge;

(b) a tubulate mouth sufficiently large to permit said cooling cartridge to be inserted through said mouth into said interior cavity of said drinking bottle, said mouth also providing lateral support for a portion of said side wall adjacent to said top surface of said cooling cartridge to maintain said cooling cartridge in a substantially vertical orientation within said bottle; and (c) a cap for removably sealing said mouth, said cap having an off-center hole for insertion of a straw in vertical alignment with one of said concave surfaces of said cooling cartridge into said beverage within said interior cavity of said drinking bottle;

said cavity of said drinking bottle having a predetermined height, wherein the predetermined height of said cooling cartridge is slightly less than said height of said cavity to prevent substantial vertical movement of said cooling cartridge within said drinking bottle.

6. The combination drinking bottle and cooling cartridge of claim 5 wherein said top surface of said cooling cartridge further comprises at least one raised vertical protrusion to allow said beverage within said bottle to flow freely past said cooling cartridge and through said opening in said cap.

7. The combination drinking bottle and cooling cartridge of claim 5 wherein said longitudinal protrusions on said cooling cartridge comprise convex ridges.

8. The combination drinking bottle and cooling cartridge of claim 5 wherein said longitudinal protrusions on said cooling cartridge are arranged in a radial pattern about a central axis.

9. The combination drinking bottle and cooling cartridge of claim 8 wherein four longitudinal protrusions form a substantially X-shaped pattern about said central axis.

* * * * *